US010597844B2

(12) United States Patent
McGargill et al.

(10) Patent No.: US 10,597,844 B2
(45) Date of Patent: Mar. 24, 2020

(54) SINGLE CYLINDER HYDRAULIC COUPLER

(71) Applicant: Diversified Products, LLC, Omaha, NE (US)

(72) Inventors: Tim M. McGargill, Omaha, NE (US); Ryan S. Morgan, Omaha, NE (US)

(73) Assignee: Diversified Products, LLC, Omaha, NE (US)

( * ) Notice: Subject to any disclaimer, the term of this patent is extended or adjusted under 35 U.S.C. 154(b) by 84 days.

(21) Appl. No.: 15/669,615

(22) Filed: Aug. 4, 2017

(65) Prior Publication Data

US 2018/0038063 A1 Feb. 8, 2018

Related U.S. Application Data

(60) Provisional application No. 62/371,468, filed on Aug. 5, 2016.

(51) Int. Cl.

| | |
|---|---|
| ***E02F 3/36*** | (2006.01) |
| ***F15B 15/06*** | (2006.01) |
| ***F15B 15/14*** | (2006.01) |

(52) U.S. Cl.

CPC ..... *E02F 3/3663* (2013.01); *F15B 15/06* (2013.01); *F15B 15/14* (2013.01); *F15B 15/149* (2013.01)

(58) Field of Classification Search

CPC ..... E02F 3/3663; F15B 15/149; F15B 15/14; F15B 15/06

USPC ..... 280/760; 414/723; 403/322.4

See application file for complete search history.

(56) References Cited

U.S. PATENT DOCUMENTS

| | | | | |
|---|---|---|---|---|
| 4,812,103 | A * | 3/1989 | Cochran | E02F 3/3631 172/272 |
| 5,147,173 | A | 9/1992 | Fauber et al. | |
| 5,562,397 | A * | 10/1996 | Albright | E02F 3/364 37/468 |
| 6,227,792 | B1 | 5/2001 | Baker et al. | |
| 6,238,130 | B1 * | 5/2001 | Youngers | E02F 3/3627 37/468 |
| 6,386,822 | B1 | 5/2002 | Burr | |
| 6,390,765 | B1 * | 5/2002 | Dick | E02F 3/3627 37/468 |
| 6,866,467 | B2 * | 3/2005 | Dvorak | E02F 3/3663 37/468 |
| 7,513,732 | B1 * | 4/2009 | Callens | E02F 3/3627 37/468 |
| 8,979,468 | B2 * | 3/2015 | Oyama | E02F 3/3627 403/322.4 |
| 10,132,054 | B2 * | 11/2018 | Ackermann | E02F 3/3618 |

(Continued)

OTHER PUBLICATIONS

Caterpillar B/C Series: CAT 247B/257B Series 3 Multi Terrain Loaders, 259B Series 3 Compact Track Loaders, http://s7d2.scene7.com/is/content/Caterpillar/C673636, accessed on Sep. 21, 2017, p. 7.

(Continued)

*Primary Examiner* — Toan C To

(74) *Attorney, Agent, or Firm* — Ballard Spahr LLP

(57) ABSTRACT

The single cylinder hydraulic coupler includes a hydraulic cylinder system, a first pivot linkage system, a second pivot linkage system, a first spring system, a second spring system, a first locking pin system, and a second locking pin system. The single cylinder hydraulic coupler couples an attachment to a machine with increased efficiency and reliability over conventional methods.

9 Claims, 6 Drawing Sheets

(56) References Cited

U.S. PATENT DOCUMENTS

| | | | | |
|---|---|---|---|---|
| 2002/0127090 | A1* | 9/2002 | Dick | E02F 3/3627 414/723 |
| 2014/0096419 | A1* | 4/2014 | Pinther | E02F 3/3627 37/468 |
| 2017/0191240 | A1* | 7/2017 | Pinther, II | E02F 3/3659 |

OTHER PUBLICATIONS

CAT, Machine Product & Service Announcements, New CAT D Series Skid Steer Loaders Feature New Cab, Operator Environment and Controls—and Increased Engine Performance, http://www.cat.com/en_US/news/machine-press-releases/new-cat-d-seriesskidsteerloadersfeaturenewcaboperatorenvironment.html, accessed on Sep. 21, 2017.

Manual Coupler: CAT 247B/257B Series 3 Multi Terrain Loaders, 259B Series 3 Compact Track Loaders, http://s7d2.scene7.com/is/content/Caterpillar/C673636, accessed on Sep. 21, 2017, p. 7.

* cited by examiner

SINGLE CYLINDER HYDRAULIC COUPLER

REFERENCE TO RELATED APPLICATIONS

This application claims the benefit of U.S. Provisional Application No. 62/371,468 entitled "Single Cylinder Hydraulic Coupler" filed Aug. 5, 2016, which is incorporated by reference in its entirety.

BACKGROUND

A continuing trend for heavy machinery (machine) is to create interchangeable work implement attachments (attachments) that may be used on a single machine. For example, a machine, such as a skid steer, may have interchangeable attachments, such as a concrete bucket, concrete crusher, digging backhoe, and material bucket, among others. Such attachments are interchangeable through the use of a coupler, where the coupler typically includes two attachment points with each attachment point typically using a locking pin mechanism to couple the attachment to the machine. The efficiency (e.g. speed) and reliability of the coupler for interchanging the attachments is paramount to the function of the machine, as the machine is inoperable for a task without a functioning attachment. Further, the coupler must be capable of maintaining efficiency and reliability in work conditions where gravel, concrete, dust, and debris are present in and around the machine.

Current couplers include manual attachment, dual cylinder hydraulic coupler, and electric actuator attachments. These couplers present practical limitations that may not produce desired efficiency and reliability. For example, the manual coupler provides reliability, but it does not produce desired efficiency as it requires manually interchanging attachments and is a time intensive process.

Conventional dual hydraulic couplers produce increased efficiency over the manual coupler, but often present reliability issues. A typical efficiency of a dual hydraulic coupler is 1.1 seconds to extend the cylinders and 0.45 seconds to retract the cylinders, where watts are equal to 60,401.7 (81 horsepower), at a 11.36 liter per minute flow rate (3 gallon per minute flow rate)), pressure is 32.62 kilograms per square centimeter (kg/sq. cm) (464 pounds per square inch (psi)), and force is equal to 98.71 kilogram meter (714 pounds-force (LBf)). The reliability of the dual hydraulic coupler is dependent on the operation of four hydraulic lines, which are susceptible to malfunction or failure from working conditions or otherwise, which reduces the dual hydraulic coupler's reliability.

Conventional electric actuator couplers produce increased efficiency over the manual coupler, but also present reliability issues. A typical efficiency of an electric actuator coupler is 4.5 seconds to extend the piston and 4.5 seconds to retract the piston, where there is 298.28 watts (0.4 horsepower) based on a voltage of 12 direct current (DC) and a maximum amperage of 26. The reliability of the electric actuator coupler is related to the susceptibility of the electric actuator coupler to malfunction under typical working conditions or otherwise. The electric actuator typically malfunctions during the coupling process, where the electric actuator and the attachment are bound together, such that the manual coupling or uncoupling of the attachment is not possible. An incident of failure when coupling an attachment with the electric actuator coupler typically leads to destruction of the electric actuator coupler as a torch is typically used to cut the electric actuator coupler to free the attachment from the machine.

It is desirable to have a heavy machine coupler with increased efficiency over the manual and electric actuator couplers to reduce the time it take to interchange attachments on the machine. It is further desirable to have a coupler with increased reliability over the dual hydraulic cylinder and electric actuator couplers to reduce coupler malfunction and failure.

SUMMARY

A single cylinder hydraulic coupler for coupling an attachment to a machine, the single cylinder hydraulic coupler includes a hydraulic cylinder system, the hydraulic cylinder system including a hydraulic cylinder, a return hose, a delivery hose, a cylinder rod, and a cylinder end, wherein the hydraulic cylinder, the return hose, the delivery hose, and the cylinder rod are in fluid communication, and wherein the hydraulic cylinder and the cylinder end are in mechanical communication a first pivot linkage in mechanical communication with the hydraulic cylinder system, the first pivot linkage including a first pivot, a first pin, a first mount bolt, and a first mounting pin, wherein the first pivot, the first pin, the first mount bolt, and the first mounting pin are in mechanical communication; a second pivot linkage in mechanical communication with the hydraulic cylinder system, the second pivot linkage including a second pivot, a second pin, a second mount bolt, and a second mounting pin, wherein the second pivot, the second pin, the second mount bolt, and the second mounting pin are in mechanical communication; a first spring system in mechanical communication with the first pivot linkage, the first spring system including a first spring, a first proximal washer, a first distal washer, and a first retaining pin, wherein the first spring, the first proximal washer, the first distal washer, and the first retaining pin are in mechanical communication; a second spring system in mechanical communication with the second pivot linkage, the second spring system including, a second spring, a second proximal washer, a second distal washer, and a second retaining pin, wherein the second spring, the second proximal washer, the second distal washer, and the second retaining pin are in mechanical communication; a first locking pin system in mechanical communication with the first spring system, the first locking pin system including a first locking pin, a first mounting pin, a first locking pin link, and a first locking pin tube, wherein the first locking pin, the first mounting pin, the first locking pin link, and the first locking pin tube are in mechanical communication; and a second locking pin system in mechanical communication with the second spring system, the second locking pin system including a second locking pin, a second mounting pin, a second locking pin link, and a second locking pin tube, wherein the second locking pin, the second mounting pin, the second locking pin link, and the second locking pin tube are in mechanical communication.

In another aspect of the invention, a single cylinder hydraulic coupler for coupling an attachment to a machine, the single cylinder hydraulic coupler includes a hydraulic cylinder system configured to have a locking position and an unlocking position, the hydraulic cylinder system including a hydraulic cylinder, a cylinder rod, and a cylinder end, wherein the cylinder and the cylinder rod are in fluid communication, and wherein the cylinder and the cylinder end are in mechanical communication; a first pivot linkage in mechanical communication with the hydraulic cylinder system, wherein the first pivot linkage configured to have the locking position and the unlocking position, and wherein the cylinder rod is configured to move the first pivot linkage to the locking position and unlocking position; a second pivot linkage in mechanical communication with the hydraulic cylinder system wherein the second pivot linkage is configured to have the locking position and the unlocking position, and wherein the cylinder end is configured to move the second pivot linkage to the locking position and the unlocking position; a first spring system in mechanical communication with the first pivot linkage, wherein the first spring system is configured to have the locking position and the unlocking position, and wherein the first pivot linkage is configured to move the first spring system to the locking position and the unlocking position; a second spring system in mechanical communication with the second pivot linkage, wherein the second spring system is configured to have the locking position and the unlocking position, and wherein the second pivot linkage is configured to move the second spring system to the locking position and the unlocking position; a first locking pin system in mechanical communication with the first spring system, wherein the first locking pin system is configured to have a locking position and an unlocking position, and wherein the first spring system is configured to move the first locking pin system to the locking position and the unlocking position; and a second locking pin system in mechanical communication with the second locking pin system, wherein the second locking pin system is configured to move between the locking position and the unlocking position, and wherein the second spring system is configured to move the second locking pin system to the locking position and the unlocking position.

In another aspect of the invention, a method of coupling an attachment to a machine with a single cylinder hydraulic coupler, the method includes engaging a momentary switch to provide a voltage that opens a hydraulic valve to supply a hydraulic pressure; delivering the hydraulic pressure to a cylinder; extending a cylinder rod of the cylinder; extending a first locking pin in mechanical communication with the cylinder; extending a second locking pin in mechanical communication with the cylinder; coupling the first locking pin and the second locking pin to the attachment, where the first locking pin and second locking pin are in mechanical communication with the attachment.

DETAILED DESCRIPTION

A single cylinder hydraulic coupler for coupling an attachment to a machine is described. The single cylinder hydraulic coupler includes a hydraulic cylinder system, a first pivot linkage system, a second pivot linkage system, a first spring system, a second spring system, a first locking pin system, and a second locking pin system. While it is to be understood that this device could be shown for use on a number of different machines, for illustration purposes, it is disclosed and described as being associated with coupling an attachment to a skid steer.

Figure 1:
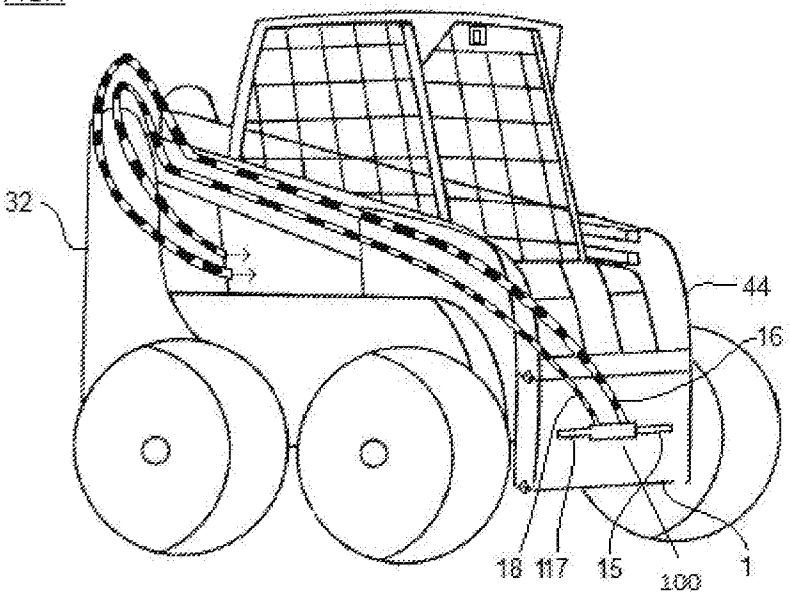
FIG. 1 is a side angle view of a skid steer having a single cylinder hydraulic coupler, a hydraulic circuitry, and a loader frame.

FIG. 1 represents a side angled view of a skid steer 32 having a single cylinder hydraulic coupler 100 without an attachment coupled. The skid steer 32 includes single cylinder hydraulic coupler 100, a hydraulic circuitry (not pictured), and a loader frame 44. The single cylinder hydraulic coupler 100 is in mechanical communication with the loader frame 44.

Figure 2:
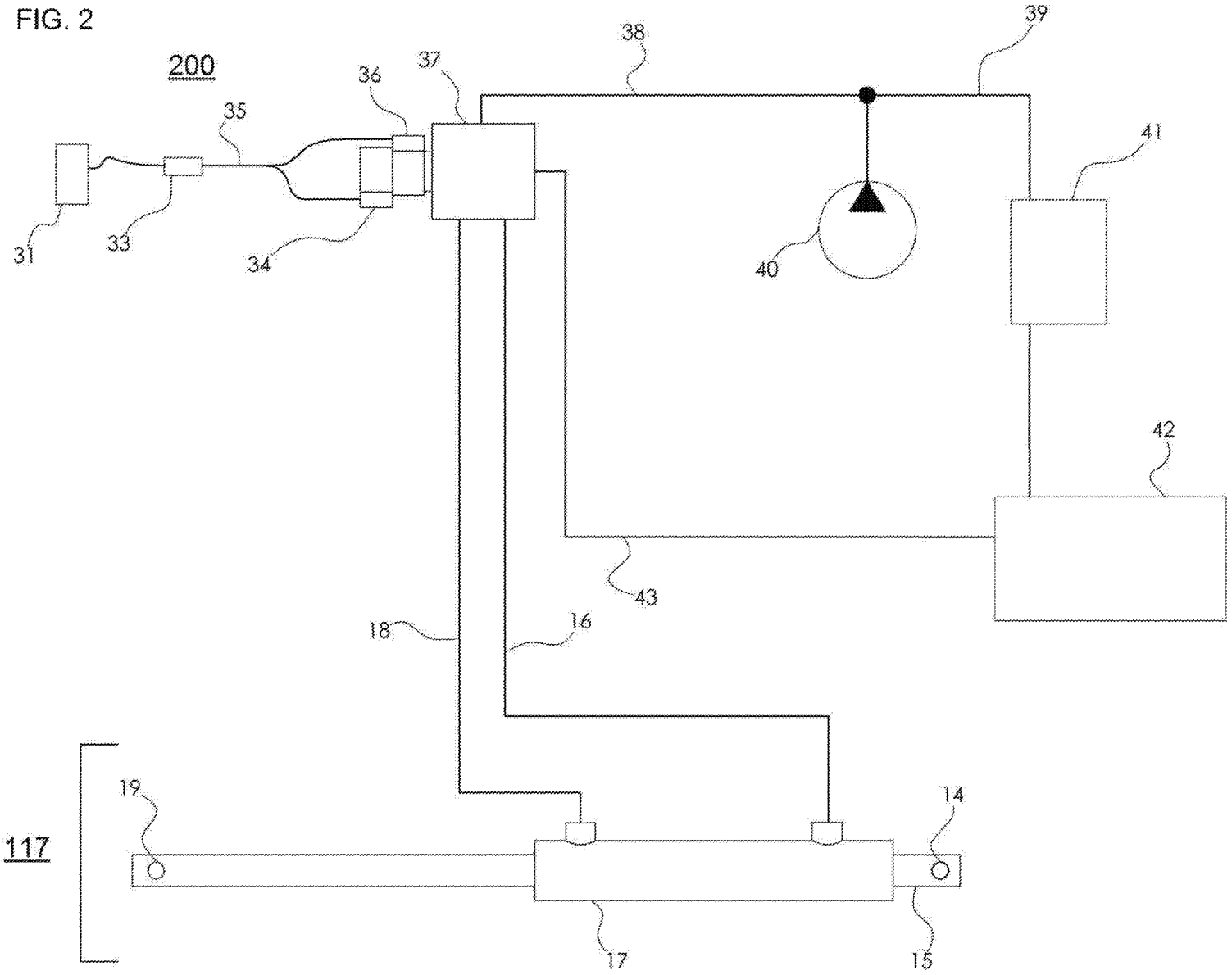
FIG. 2 is a schematic diagram of hydraulic circuitry that provides pressurized fluid to the single cylinder hydraulic coupler.

FIG. 2 is a schematic diagram of the hydraulic circuitry 200. The hydraulic circuitry 200 is configured to supply fluid pressure to the hydraulic cylinder system 117. A momentary switch 31 engages and disengages the hydraulic circuitry 200. When the momentary switch 31 is engaged in a locking manner, the momentary switch 31 supplies a system voltage to the locking electro-hydraulic solenoid 34 via a connector 33 and adapter harness 35. The locking electro-hydraulic solenoid 34 opens a hydraulic valve 37 to provide pressurized fluid from a charge pump 40 to a delivery charge pump hose 38. The charge pump hose 38 provides pressurized fluid to a locking hose 18.

Locking hose 18 provides pressurized fluid to the hydraulic cylinder system 117, which extends a cylinder rod 15 of the hydraulic cylinder 17 to a locked position. When the momentary switch 31 is engaged in locking, the pressurized fluid supplied to the hydraulic cylinder system 117 returns to a machine hydraulic tank 42 via an unlocking hose 16, the hydraulic valve 37, and a return machine hose 43.

When disengaged from the locking manner, the momentary switch 31 closes the hydraulic valve 37, which blocks pressurized fluid flow from the machine charge pump 40 to the locking hose 18. Pressurized fluid flows from the machine charge pump 40 through the machine charge pump hose 38, the hydraulic valve 37, the return machine hose 43, the machine hydraulic tank 42, and returns to the machine charge pump 40. Further, when the momentary switch 31 is disengaged from the locking manner ports of the hydraulic cylinder system 117 to the machine tank 42 are open, which relieves pressure in the lines, such that the hydraulic cylinder system remains static in the locked position.

When the momentary switch 31 is engaged in an unlocking manner, the momentary switch 31 supplies a system voltage to the unlocking electro-hydraulic solenoid 36 via a connector 33 and adapter harness 35. The unlocking electro-hydraulic solenoid 36 opens the hydraulic valve 37 to supply pressurized fluid from the machine charge pump 40 to the delivery machine charge pump hose 38. The delivery machine charge pump hose 38 provides pressurized fluid to an unlocking hose 16.

Unlocking hose 16 provides pressurized fluid to the hydraulic cylinder system 117, which retracts the cylinder rod 15 of the hydraulic cylinder system 117 to an unlocked position. When the momentary switch 31 is engaged in unlocking, the pressurized fluid supplied to the hydraulic cylinder system 117 returns to a machine hydraulic tank 42 via the locking hose 18, the hydraulic valve 37, and a return machine hose 43.

When the momentary switch 31 is disengaged from the unlocking manner, the hydraulic valve 37 is closed and blocks pressurized fluid flow from the machine charge pump 40 to the unlocking hose 16, causing the pressurized fluid to flow from the machine charge pump 40 through the machine charge pump hose 38, the hydraulic valve 37, the return machine hose 43, the machine hydraulic tank 42, and return to the machine charge pump 40. Further, when the momentary switch 31 is disengaged from the unlocking manner ports of the hydraulic cylinder system 117 to the machine tank 42 are open, which relieve pressure in the lines, such that the hydraulic cylinder system remains static in the unlocked position.

The hydraulic circuitry 200 may include an outlet hose 39 to an existing charge circuit 41 of the skid steer 32. The existing charge circuit 41 provides pressurized fluid to components of the skid steer 32.

Figure 3:
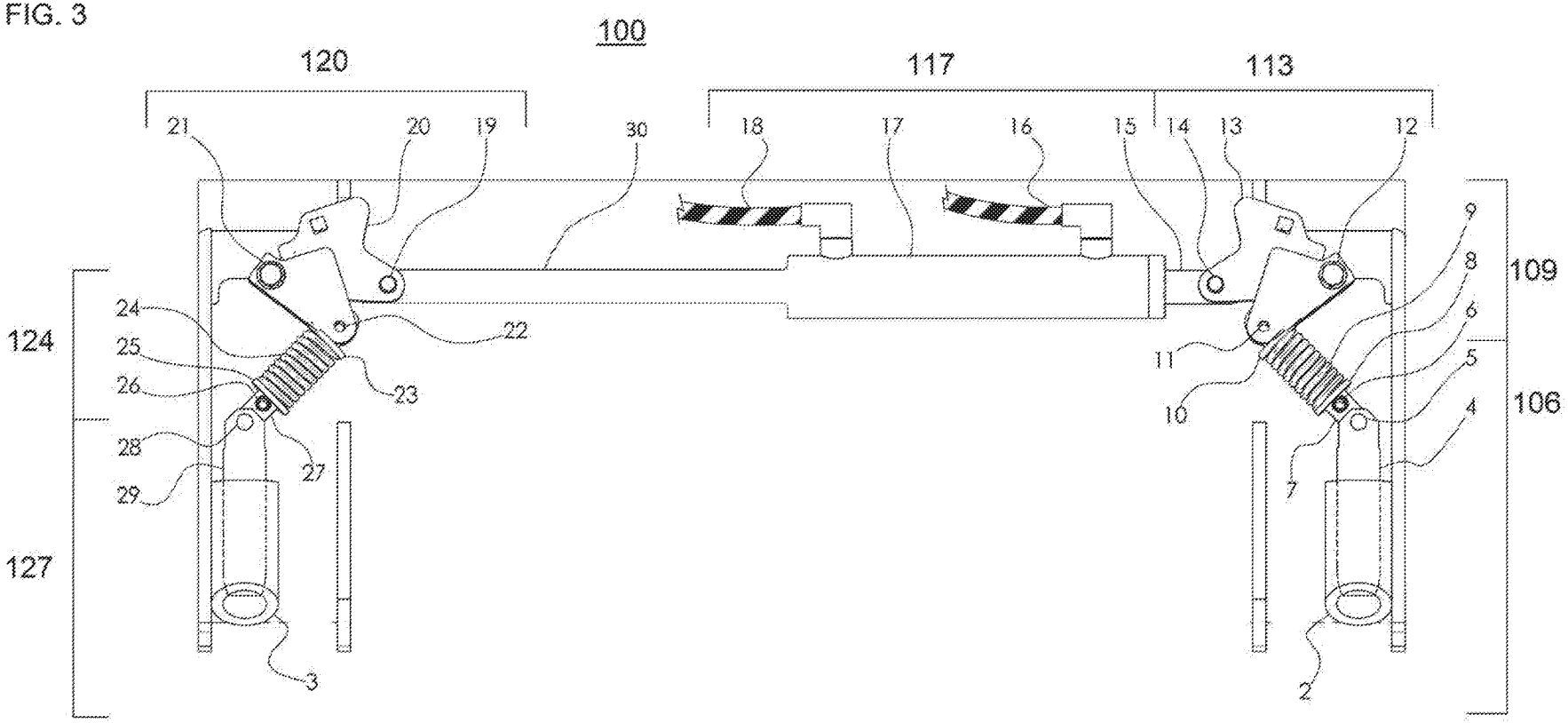
FIG. 3. is a front view of the single cylinder hydraulic coupler in an unlocked position.

FIG. 3 represents the single cylinder hydraulic coupler 100 in an unlocked position. The single cylinder hydraulic coupler 100 includes a hydraulic cylinder system 117, a first pivot linkage 113, a second pivot linkage 120, a first spring system 109, a second spring system 124, a first locking pin system 106, and a second locking pin system 127. The hydraulic cylinder system 117 may include a locking hose 18, an unlocking hose 16, a hydraulic cylinder 17, a cylinder rod 15, and a cylinder end 30. The locking hose 18, unlocking hose 16, hydraulic cylinder 17, and cylinder rod 15 are in fluid communication. The hydraulic cylinder 17 is in mechanical communication with the cylinder end 30, where the cylinder end 30 may be square tubing, made of a non-reactive material, such as metal or a synthetic polymer.

The first pivot linkage 113 may include, a first pivot 13, a first pin 14, a first mount bolt 12, and a first mounting pin 11. The first pivot linkage 113 is in mechanical communication with the hydraulic cylinder 17 via the cylinder rod 15 and first pin 14. In the unlocked position, the first pivot linkage 113 is centered with the first spring system 109.

The second pivot linkage 120 may include, a second pivot 20, a second pin 19, a second mount bolt 21, and a second mounting pin 22. The second pivot linkage 120 is in mechanical communication with the hydraulic cylinder 17 via the cylinder end 30 and the second pin 19. In the unlocked position the second pivot linkage 120 is centered with the second spring system 124.

The first spring system 109 may include, a first spring 9, a first proximal washer 10, a first distal washer 8, and a first retaining pin 6. The first spring 9, first proximal washer 10, first distal washer 8, and first retaining pin 6 are in mechanical communication. The first spring system 109 is in mechanical communication with the first pivot linkage 113 via the first mounting pin 11 and first spring 9. In the unlocked position the first spring system 109 is center with the first locking pin system 106.

The second spring system 124 may include a second spring 24, a second proximal washer 23, a second distal washer 25, and a second retaining pin 26. The second spring 24, second proximal washer 23, second distal washer 25, and second retaining pin 26 are in mechanical communication. The second spring system 124 is in mechanical communication with the second pivot linkage 120 via the second mounting pin 22 and second spring 23. In the unlocked position the second spring system 124 is center with the second locking pin system 127.

The first locking pin system 106 is configured for locking an attachment to the single cylinder hydraulic coupler 100 and may include a first locking pin 4, a first mounting pin 5, a first locking pin link 7, and a first locking pin tube 2. The first locking pin 4, first mounting pin 5, first locking pin link 7 and first locking pin tube 2 are in mechanical communication. The first locking pin system is in mechanical communication with the first spring system 109 via the first mounting pin 5 and the spring 7. In an unlocked position the first locking pin system 106 is in a retracted position, where the the first locking pin 4 is retracted inside the first locking pin tube 2, such that the first locking pin 4 is not in mechanical communication with an attachment.

The second locking pin system 127 is configured for locking an attachment to the single hydraulic coupler 100 and may include a second locking pin 29, a second mounting pin 28, a second locking pin link 27, and a second locking pin tube 3. The second locking pin 29, second mounting pin 28, second locking pin link 27, and second locking pin tube 3 are in mechanical communication. The second locking pin system 127 is in mechanical communication with the second spring system 124 via the second mounting pin 28 and the spring 24. In an unlocked position the second locking pin system 127 is in a retracted position, where the second locking pin 29 is retracted inside the second locking pin tube 3 such that the second locking pin 29 is not in mechanical communication with an attachment.

Figure 4:
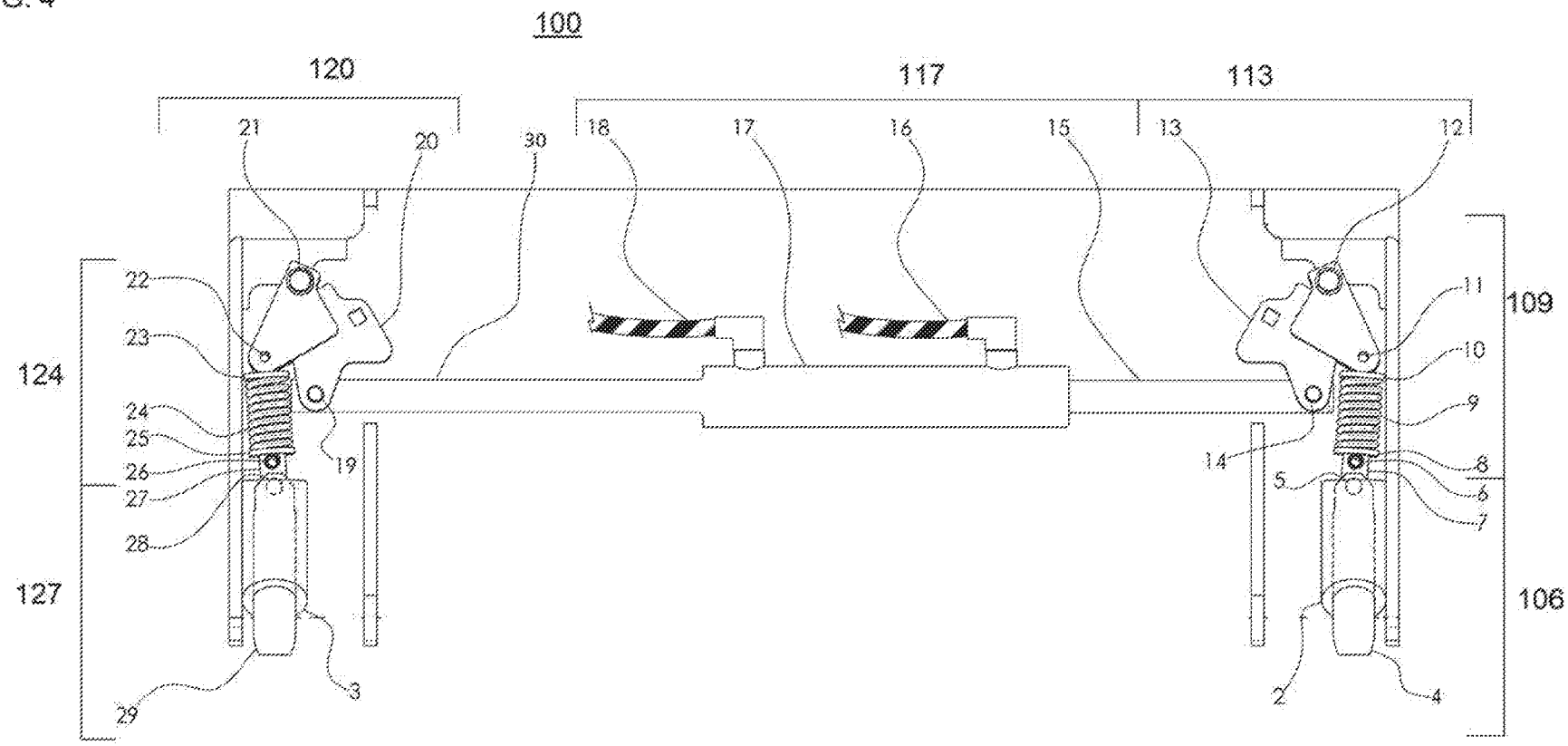
FIG. 4 is a front view of the single cylinder hydraulic coupler in a locked position.

FIG. 4 represents the single cylinder hydraulic coupler 100 in a locked position. In the locked position, the first pivot linkage 113 is on an even vertical plane with the first spring system 109. In the locked position the second pivot linkage 120 is on an even vertical plane to the second spring system 124. In the locked position, the first spring system 109 is past center with the first locking pin system 106. In the locked position, the second spring system 124 is past center with the second locking pin system 127. In a locked position, the first locking pin system 106 is in an extended position, where the the first locking pin 4 is extended outside the first locking pin tube 2, such that the first locking pin 4 is in mechanical communication with an attachment. In a locked position, the second locking pin system 127 is in an extended position, where the second locking pin 29 is extended outside the second locking pin tube 3, such that the second locking pin 29 is in mechanical communication with the attachment.

In the event of a failure of the single cylinder hydraulic coupler 100 where the single cylinder hydraulic coupler 100 is not fully in the unlocked position, the single cylinder hydraulic coupler 100 may be put in the unlocked position manually. To manually put the single cylinder hydraulic coupler 100 in the unlocked position, the operator may force the hydraulic cylinder into the unlocked position by applying upward force with a pry-bar positioned between the hydraulic cylinder 17 and the loader frame 44. The exertion of this manual force positions the single cylinder hydraulic coupler 100 in the unlocked position as described in FIG. 3.

Figure 5:
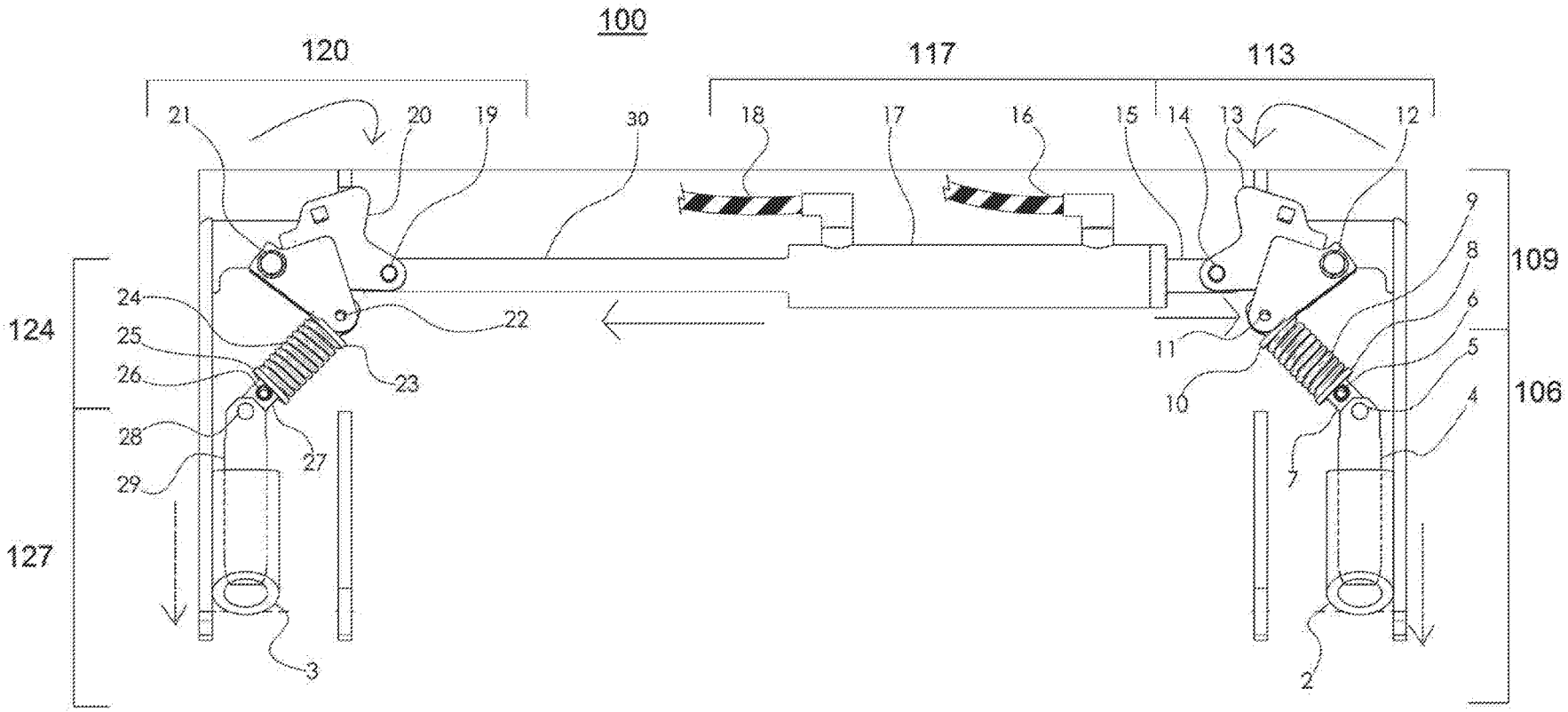
FIG. 5 illustrates a method of coupling an attachment with a single cylinder hydraulic coupler.

FIG. 5 illustrates a method for coupling an attachment to a machine with a single cylinder hydraulic coupler 100. A momentary switch (not pictured) is engaged in a locking manner to engage a hydraulic circuitry (not pictured), which supplies a system voltage to a locking electro-hydraulic solenoid (not pictured) via a connector (not pictured) and an adapter harness (not pictured) to open a hydraulic valve (not pictured) to supply a hydraulic pressure from a machine charge pump (not picture).

The hydraulic pressure is delivered to a hydraulic cylinder 17 of the single cylinder hydraulic coupler 100 through a locking hose 18. The hydraulic pressure supplied to the hydraulic cylinder 17 may be 34.45 kilograms per square centimeter (490 pounds per square inch (psi)).

The hydraulic pressure extends a cylinder rod 15 of the hydraulic cylinder 17. The cylinder rod 15 exerts a first force on a first pin 14. A cylinder end 30 exerts a second force on the second pin 19 simultaneously or nearly simultaneously. The first force acted on the cylinder rod 15 may be 98.71 kilogram meter (714 LBf) and the second force acted on the cylinder end 30 may be 98.71 kilogram meter (714 LBf). The simultaneous or nearly simultaneous first force and second force applied to the first pin 14 and the second pin 19, respectively, causes counterclockwise rotation of a first pivot 13 and clockwise rotation of a second pivot 20.

The counterclockwise rotation of the first pivot 13 positions a first pin 14 distal to a first mount bolt 12. The clockwise rotation of the second pivot 20 positions a second pin 19 distal to a second mount bolt 21. The counterclockwise rotation of the first pivot 13 forces the first spring system 109 past center of the first locking pin system 106. The clockwise rotation of the second pivot 20 forces the second spring system 124 past center of the second locking pin system 127.

The past center position of the first spring 9 exerts force on the first proximal washer 10 and first distal washer 6 where the exerted force holds the first spring system 109 past center. The past center position of the second spring 24 exerts force on a second proximal washer 23 and a second distal washer 25 where the exerted force holds a second spring system 124 past center. The past center position of the first spring system 109 exerts force on the first locking pin system 106. The past center position of the second spring system 124 exerts force on the second locking pin system 127.

The force on the first locking pin system 106, extends the first locking pin 4 out of the first locking pin tube 2. The force on the second locking pin system 127 extends the second locking pin 29 out of the second locking pin tube 3.

The extension of the first locking pin 4, couples the first locking pin 4 in mechanical communication with the attachment. The extension of the second locking pin 29, couples the second locking pin 29 in mechanical communication with the attachment.

The weight of the hydraulic cylinder 17, the friction between the cylinder rod 15 and the internal of the hydraulic cylinder 17, and the past center positions of the first spring system 109 and second spring system 124, keep the first pin 4 and second pin 29 in the extended positions and coupled in mechanical communication with the attachment.

Figure 6:
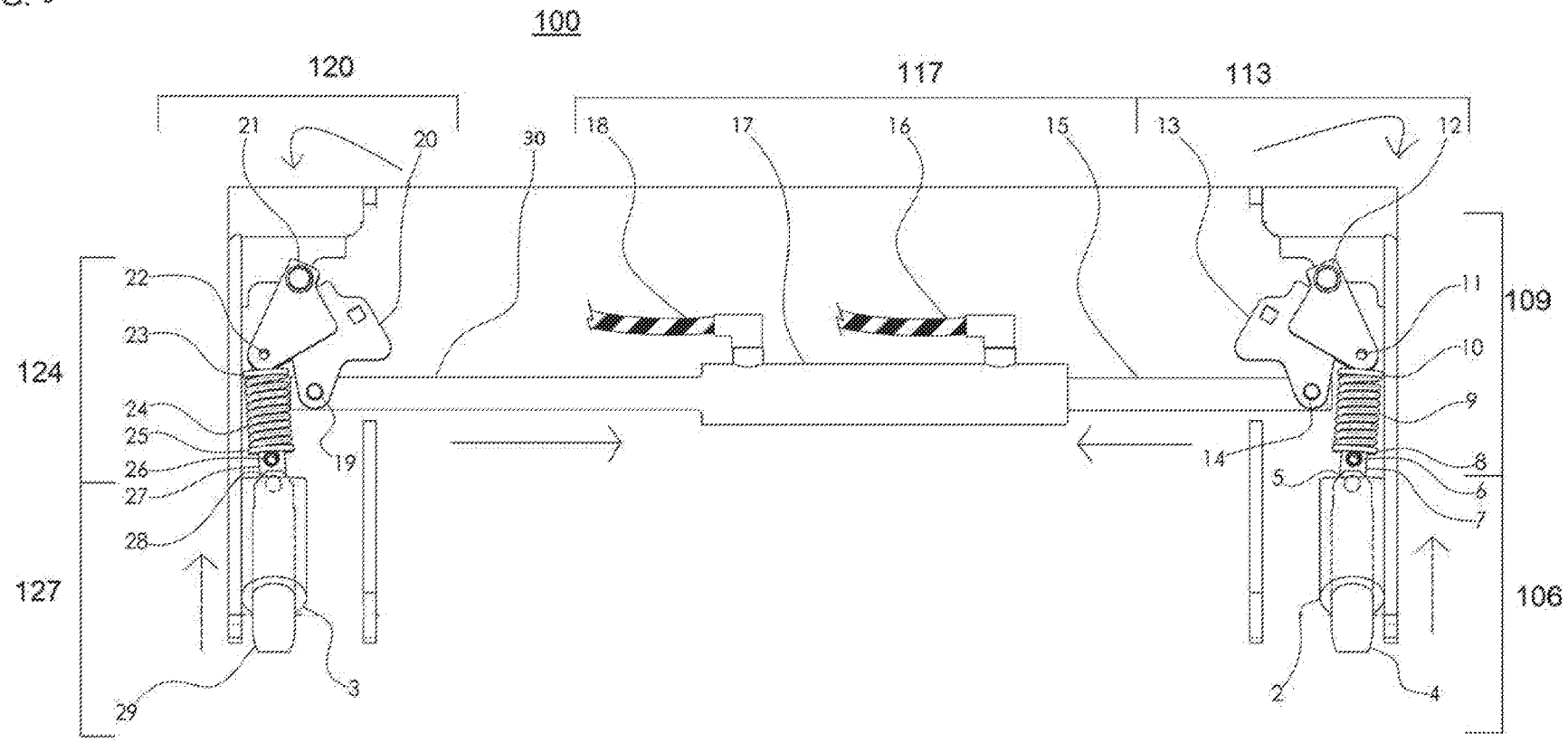
FIG. 6 illustrates a method of uncoupling an attachment with a single cylinder hydraulic coupler.

FIG. 6 illustrates a method for uncoupling the attachment from the machine with the single cylinder hydraulic coupler. The momentary switch (not pictured) is engaged in an unlocking manner, which supplies a system voltage to the unlocking electro-hydraulic solenoid (not pictured). The unlocking electro-hydraulic solenoid (not pictured) opens the hydraulic valve (not pictured) to supply a hydraulic pressure from the machine charge pump (not pictured).

The hydraulic pressure is delivered to the hydraulic cylinder 17 of the single cylinder hydraulic coupler 100 through the unlocking hose 16. The pressure supplied to the hydraulic cylinder 17 may be 34.45 kilograms per square centimeter (490 psi).

The hydraulic pressure retracts the cylinder rod 15 of the hydraulic cylinder 17. The cylinder rod 15 exerts a third force on the first pin 14. A cylinder end 30 exerts a fourth force on the second pin 19 simultaneously or nearly simultaneously. The simultaneous or nearly simultaneous first force and second force applied to the first pin 14 and the second pin 19, respectively, causes clockwise rotation of the first pivot 13 and counterclockwise rotation of the second pivot 20.

The clockwise rotation of the first pivot 13 positions the first pin 14 centered with the first spring 9. The counterclockwise rotation of the second pivot 20 positions the second pin 19 centered with the second spring 24. The clockwise rotation of the first pivot 13 forces the first spring system 109 center with the first locking pin system 106. The counterclockwise rotation of the second pivot 20 forces the second spring system 124 center with the second locking pin system 127.

The centering of the first locking pin system 106 retracts a first locking pin 4 into a first locking pin tube 2, such that the first locking pin 4 is not in mechanical communication with the attachment. The centering of the second locking pin system 127 retracts a second locking pin 29 into a second locking pin tube 3, such that the second locking pin 29 is not in mechanical communication with the attachment.

The friction between the cylinder rod end 15 and the internal of hydraulic cylinder 17 holds the first pin 4 and second pin 29 retracted and the single cylinder hydraulic coupler 100 not coupled to the attachment in mechanical communication.

The invention claimed is:

1. A single cylinder hydraulic coupler for coupling an attachment to a machine, the single cylinder hydraulic coupler comprising:

a hydraulic cylinder system, the hydraulic cylinder system comprising:

a hydraulic cylinder, a return hose, a delivery hose, a cylinder rod, and a cylinder end, wherein the hydraulic cylinder, the return hose, the delivery hose, and the cylinder rod are in fluid communication, and wherein the hydraulic cylinder and the cylinder end are in mechanical communication;

a first pivot linkage in mechanical communication with the hydraulic cylinder system, the first pivot linkage comprising a first pivot, a first pin, a first mount bolt, and a first mounting pin, wherein the first pivot, the first pin, the first mount bolt, and the first mounting pin are in mechanical communication;

a second pivot linkage in mechanical communication with the hydraulic cylinder system, the second pivot linkage comprising a second pivot, a second pin, a second mount bolt, and a second mounting pin, wherein the second pivot, the second pin, the second mount bolt, and the second mounting pin are in mechanical communication;

a first spring system in mechanical communication with the first pivot linkage, the first spring system comprising a first spring, a first proximal washer, a first distal washer, and a first retaining pin, wherein the first spring, the first proximal washer, the first distal washer, and the first retaining pin are in mechanical communication;

a second spring system in mechanical communication with the second pivot linkage, the second spring system comprising, a second spring, a second proximal washer, a second distal washer, and a second retaining pin, wherein the second spring, the second proximal washer, the second distal washer, and the second retaining pin are in mechanical communication;

a first locking pin system in mechanical communication with the first spring system, the first locking pin system comprising a first locking pin, a first mounting pin, a first locking pin link, and a first locking pin tube, wherein the first locking pin, the first mounting pin, the first locking pin link, and the first locking pin tube are in mechanical communication; and a second locking pin system in mechanical communication with the second spring system, the second locking pin system comprising a second locking pin, a second mounting pin, a second locking pin link, and a second locking pin tube, wherein the second locking pin, the second mounting pin, the second locking pin link, and the second locking pin tube are in mechanical communication.

2. The single cylinder hydraulic coupler of claim 1, wherein the cylinder end is square tubing.

3. The single cylinder hydraulic coupler of claim 1, wherein the cylinder end is metal.

4. The single cylinder hydraulic coupler of claim 1, further comprising a hydraulic circuitry in fluid communication with the hydraulic cylinder system, the hydraulic circuitry comprising, a momentary switch, a hydraulic valve, a charge pump, a locking hose, and an unlocking hose, wherein the hydraulic valve, the charge pump, the locking hose, and the unlocking hose are in fluid communication.

5. The single cylinder hydraulic coupler of claim 4, wherein the hydraulic circuitry further comprises a connector, an adapter harness, a locking electro-hydraulic solenoid, an unlocking electro-hydraulic solenoid, a machine charge pump hose, and a machine hydraulic tank, wherein the connector, the adapter harness, the locking electro-hydraulic solenoid, the unlocking electro-hydraulic solenoid, the machine charge pump hose, and the machine hydraulic tank are in fluid communication with the hydraulic valve, the charge pump, the locking hose, and the unlocking hose.

6. A single cylinder hydraulic coupler for coupling an attachment to a machine, the single cylinder hydraulic coupler comprising:

a hydraulic cylinder system configured to have a locking position and an unlocking position, the hydraulic cylinder system comprising a hydraulic cylinder, a cylinder rod, and a cylinder end, wherein the cylinder and the cylinder rod are in fluid communication, and wherein the cylinder and the cylinder end are in mechanical communication;

a first pivot linkage in mechanical communication with the hydraulic cylinder system, wherein the first pivot linkage configured to have the locking position and the unlocking position, and wherein the cylinder rod is configured to move the first pivot linkage to the locking position and unlocking position;

a second pivot linkage in mechanical communication with the hydraulic cylinder system wherein the second pivot linkage is configured to have the locking position and the unlocking position, and wherein the cylinder end is configured to move the second pivot linkage to the locking position and the unlocking position;

a first spring system in mechanical communication with the first pivot linkage, wherein the first spring system is configured to have the locking position and the unlocking position, and wherein the first pivot linkage is configured to move the first spring system to the locking position and the unlocking position;

a second spring system in mechanical communication with the second pivot linkage, wherein the second spring system is configured to have the locking position and the unlocking position, and wherein the second pivot linkage is configured to move the second spring system to the locking position and the unlocking position;

a first locking pin system in mechanical communication with the first spring system, wherein the first locking pin system is configured to have a locking position and an unlocking position, and wherein the first spring system is configured to move the first locking pin system to the locking position and the unlocking position; and a second locking pin system in mechanical communication with the second locking pin system, wherein the second locking pin system is configured to move between the locking position and the unlocking position, and wherein the second spring system is configured to move the second locking pin system to the locking position and the unlocking position.

7. The single cylinder hydraulic coupler of claim 6, wherein the cylinder rod is square tubing.

8. The single cylinder hydraulic coupler of claim 6, wherein, the cylinder rod is metal.

9. The single cylinder hydraulic coupler of claim 6, further comprising a hydraulic circuitry in hydraulic communication with the hydraulic cylinder system, wherein the hydraulic circuitry is configured to move the hydraulic cylinder system to the locking position and the unlocking position.

* * * * *